United States Patent [19]

Kopacz

[11] 4,262,897

[45] Apr. 21, 1981

[54] VERTICAL-TO-HORIZONTAL CONVEYOR SYSTEM

[75] Inventor: Thomas J. Kopacz, Omro, Wis.

[73] Assignee: Kimberly-Clark Corporation, Neenah, Wis.

[21] Appl. No.: 80,629

[22] Filed: Oct. 1, 1979

[51] Int. Cl.[3] ..... B65H 29/00

[52] U.S. Cl. ..... 271/185; 271/175; 271/272; 271/309

[58] Field of Search ..... 271/225, 184, 185, 67, 271/175, 272, 73, 306, 307, 309

[56] References Cited

U.S. PATENT DOCUMENTS

| | | | |
|---|---|---|---|
| 3,295,483 | 1/1967 | Rothfuss | 271/175 X |
| 3,549,145 | 12/1970 | Trautmann | 271/204 X |
| 3,704,884 | 12/1972 | Nicolay | 271/175 |

*Primary Examiner*—Richard A. Schacher

*Attorney, Agent, or Firm*—Wendell K. Fredericks; William D. Herrick

[57] ABSTRACT

An in-line vertical-to-horizontal conveying system useful for transferring flexible sheet material from a vertical location to a horizontal position is disclosed. A triangular shaped material transition board means is utilized to effect the transfers. Further, hold-down bars and endless belts are used to maintain continuous flow of the sheets over a surface of the transition board means.

6 Claims, 5 Drawing Figures

VERTICAL-TO-HORIZONTAL CONVEYOR SYSTEM

BACKGROUND OF THE INVENTION

Field of the Invention

The present invention relates generally to material conveying systems and particularly to in-line vertical-to-horizontal conveying system for transferring light-weight and flexible sheet material such as plastic bags from a vertical feed station to a horizontal take-away conveyor.

Techniques for conveying flexible material from a vertical supply station to a horizontally disposed stacking station are well known. Apparatus have been devised to handle effectively flexible material in a manner to permit efficient automatic transfer of the materials from a vertical location to a horizontal location. But, however, such prior art apparatus are not suited for automatic, in-line conveying of light-weight, flexible materials such as polyethylene plastic bags.

SUMMARY

The present invention relates to a method and apparatus for in-line material conveying of vertically suspended sheet materials along a horizontal path to a horizontal position. The method comprises the steps of folding an edge margin region of the material from a vertical orientation to a horizontal orientation. Then the sheet is so moved over a triangular-shaped transition board so as to cause the remainder of the sheet material to be oriented horizontally.

To practice the above method, a system is provided for transferring sheets of vertically suspended material along a horizontal path to a horizontal position, including means for supplying the vertically suspended sheets of flexible material along a horizontal path; and a horizontally disposed take-away conveyor. The system comprises means for folding a bottom margin region from a vertical orientation to a horizontal orientation, means for transferring each vertically suspended sheet with the bottom margin region folded along a horizontal path, and transition means disposed between the transferring means and the horizontally disposed take-away conveyor for transferring each sheet of flexible material from the transferring means to the horizontally disposed take-away conveyor.

DESCRIPTION OF THE PREFERRED EMBODIMENT

Figure 1:
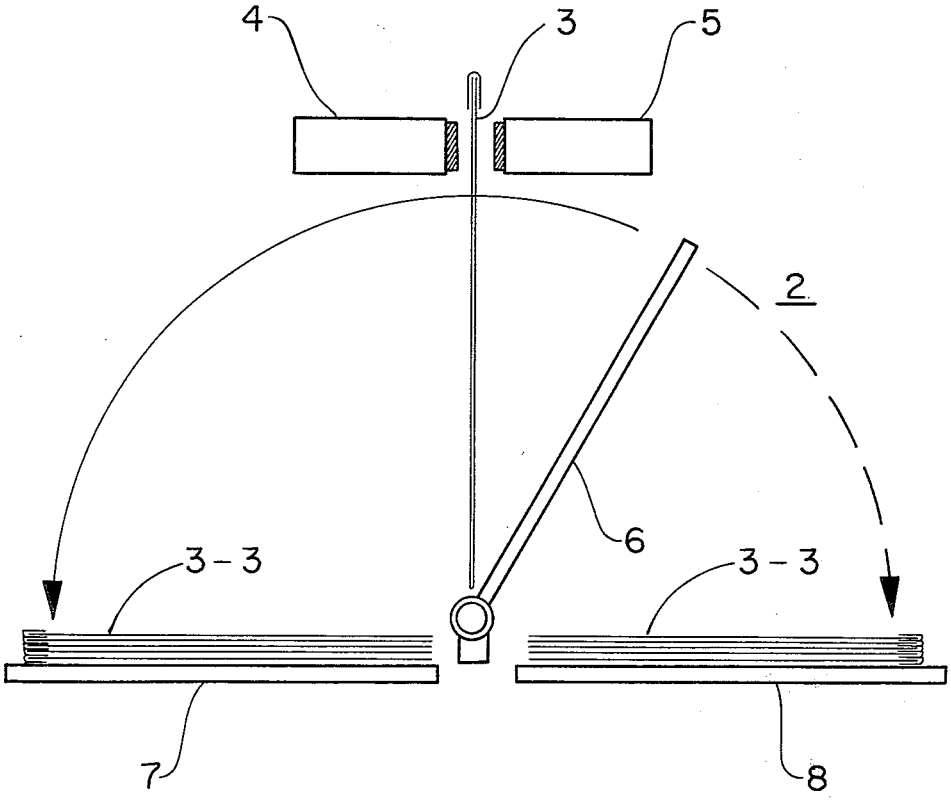
FIG. 1 ( PRIOR ART )
FIG. 1 is a basic vertical-to-horizontal conveying system.

Referring to the drawing figures, there is shown in FIG. 1 a basic prior art vertical-to-horizontal conveying system 2. A bag making machine (not shown) is utilized to supply a series of container bags 3 along a vertical path by means of a pair of take-off belts 4 and 5. As each bag is released from the take-off belts, a stacking rack 6 intercepts the bag and places the bags alternately on a pair of accumulating tables 7 and 8.

Such a conveying system operates very efficiently to transfer 8- to 16-ounce bags from a vertical location to a horizontal location since such bags possess enough physical weight and stiffness to permit reasonable unrestrained machine handling. However, when bags weighing from 1- to 3-ounces are transported by such prior art systems, the operation becomes futile due to the flimsiness of the bags. Both the bag making machine and the conveyors must be slowed to an undesirable rate in order to maintain control over the bag.

Figure 2:
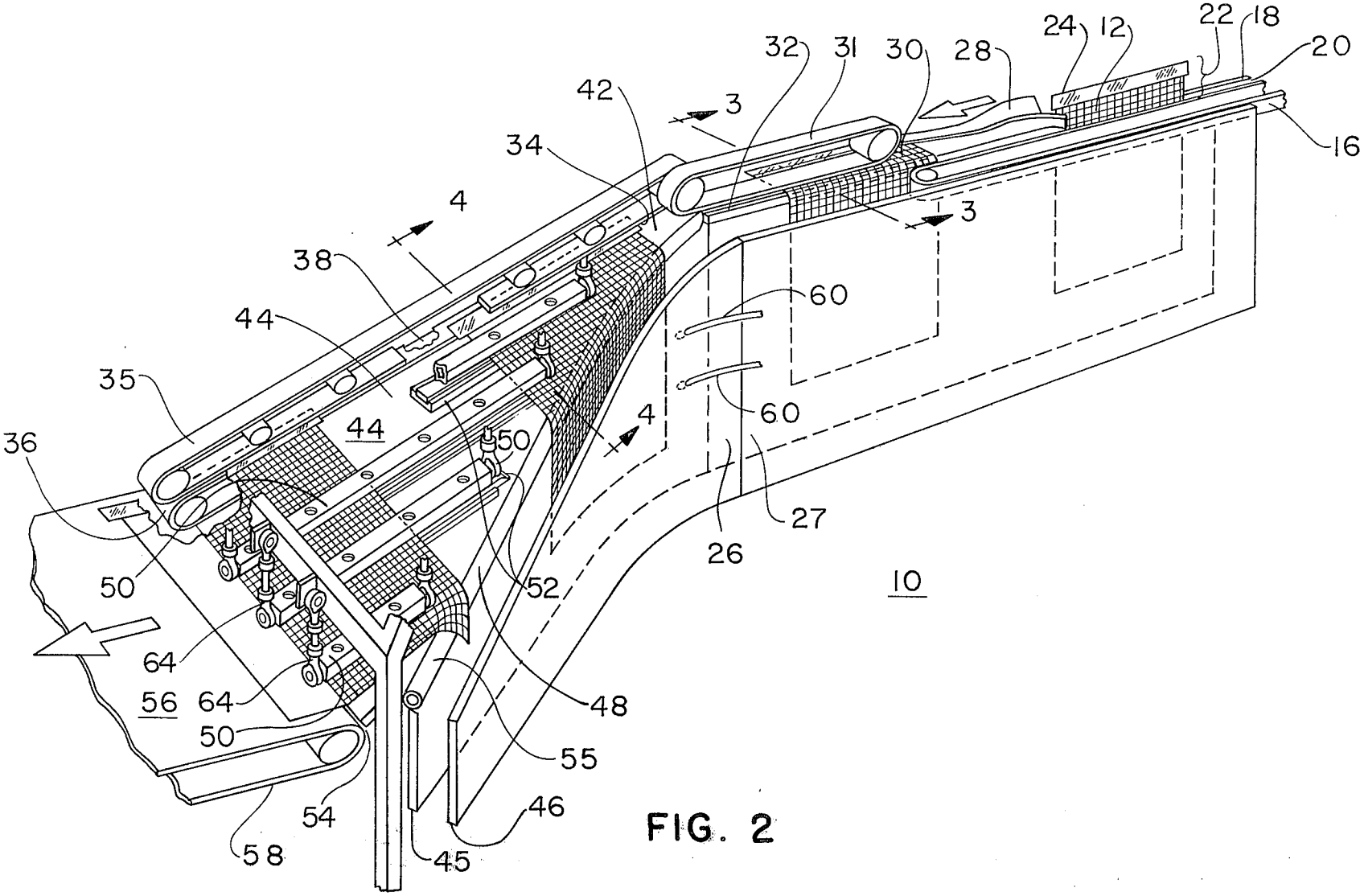
FIG. 2 is a perspective view of a preferred embodiment of the invention.

To provide an automatic and fast, in-line system for transferring a series of preformed open-mouth trash bags, weighing, illustratively, from 1- to 3-ounces, from a bag making machine to a bag folding machine, a preferred embodiment of a vertical-to-horizontal conveyor apparatus 10 is depicted in FIG. 2.

The bags 12 transferred by the vertical-to-horizontal conveyor of this invention are formed, illustratively, by folding in half a sheet of scrim reinforced polyethylene material, heat sealing the material along abutting edges of the folded sheet to form a tube stock, then fusing by heat sealing, a length of polyethylene tape to a bottom margin region of the tube stock, leaving a top margin unsealed to form a light-weight (i.e. 1- to 3-ounces) trash bag.

The bag making machine (not shown) supplies preformed trash bags 12 from an exit-end to conveyor 10 over a pair of horizontally disposed transfer belts 16 and 18. The belts are spaced apart to define a small horizontal width cavity 20, that is, illustratively 4 mils wide, for engaging a bottom margin region 22 of the bag which extends approximately two-inches below a bottom edge 24. The remainder of the bag is left to hang down unrestrained between a pair of vertically mounted tunnel plates 26 and 27.

A plow member 28, fixedly mounted to a top surface of the pair of tunnel plates, is used to fold region 22 of bag 12 over from a vertical to a horizontal orientation.

Figure 3:
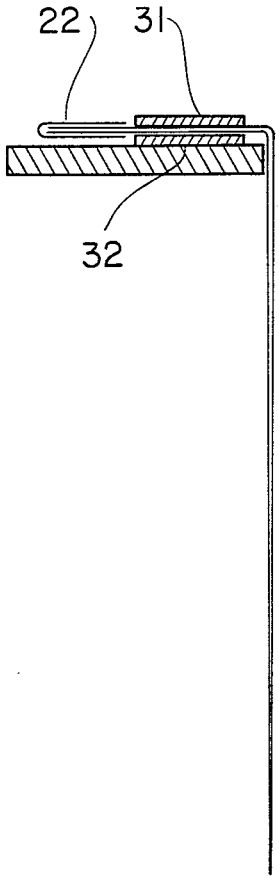
FIGS. 3 and 4 are cross-section views taken along lines 3—3 and 4—4 of FIG. 2 respectively.

The horizontally oriented region 22 exits the plow member and enters a first vertical-width cavity 30 formed between a first pair of vertically disposed endless belts 31 and 32. Endless belts 31 and 32 are used to transfer each bag 12 with the margin regions folded (best seen in FIG. 3) from plow member 28 to a second vertical-width cavity 34 of a second pair of vertically disposed endless belts 35 and 36 that extend along a height side 38 of a triangular shaped bag, transition board 40. The horizontally oriented region 22 exits cavity 30 and enters the second vertical width cavity 34 near an apex region 42 of the triangular shaped, bag transition board. As the region 22 of bag 12 is conveyed along the height side of board 40, the remainder of the bag is moved partially over a top surface 44 of board 40 and partially between a pair of vertically disposed triangular shaped tunnel plates 45 and 46 which are mounted perpendicular to the hypotenuse side of the transition board 40. A flexible transition rod 55, illustratively a Teflon bar, is curvaturely mounted along a top surface of plate 45 to provide a desired flow of the bag material along the hypotenuse side 48 of board 40.

Figure 4:
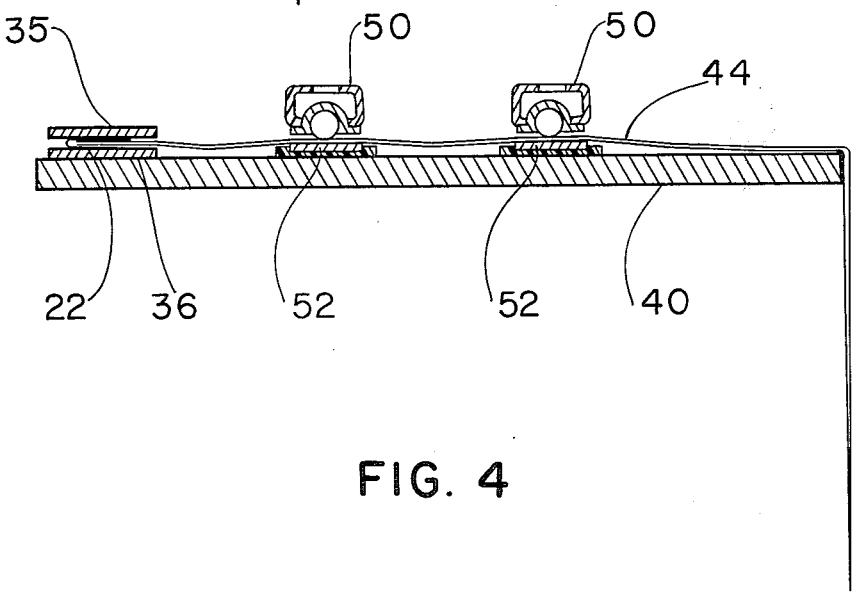

A plurality of ball bearing, hold-down bars 50—50, having a multiplicity of ball bearings disposed at desired locations along the bar are mounted over top surface 44 from a frame structure (not shown), and are used to restrain the bags from air resistance and turbulence as the bags travel over top surface 44 (best seen in FIG. 4).

Below each ball bearing, hold-down bar 50 and over the top surface 44 of board 40, a plurality of endless conveyor belts 52—52 span the length of the board, and are spaced substantially at equal space intervals. Belts 52—52 are used to assist the flow of bags over top surface 44 from the apex region 42 to a base side 54 of board 40, the base side 54 being disposed to be horizontal with respect to tunnel plates 26 and 27.

To facilitate this desired flow of bags over board 40, the hypotenuse side 48 is formed at an angle approximately 75° with respect to the base side 54, and the top surface 44 is sloped at approximately 10° with respect to a horizontally disposed top surface 56 of a take-away conveyor 58.

The top edges of the vertically disposed triangular shaped tunnel plates are formed to descend at an angle corresponding to the slope of top surface 44 of board 40. The inner walls of tunnel plates 45 and 46 are lined with a plurality of horizontally positioned strips (not shown) of a suitable material to prevent static electric buildup between the plates resulting when the bags travel between the tunnel plates.

To further aid the travel of the enclosed portion of the bags 12—12 through tunnel plates 45 and 46, a plurality of air nozzles 60—60 are deplored to direct air streams in the direction of bag flow.

Figure 5:
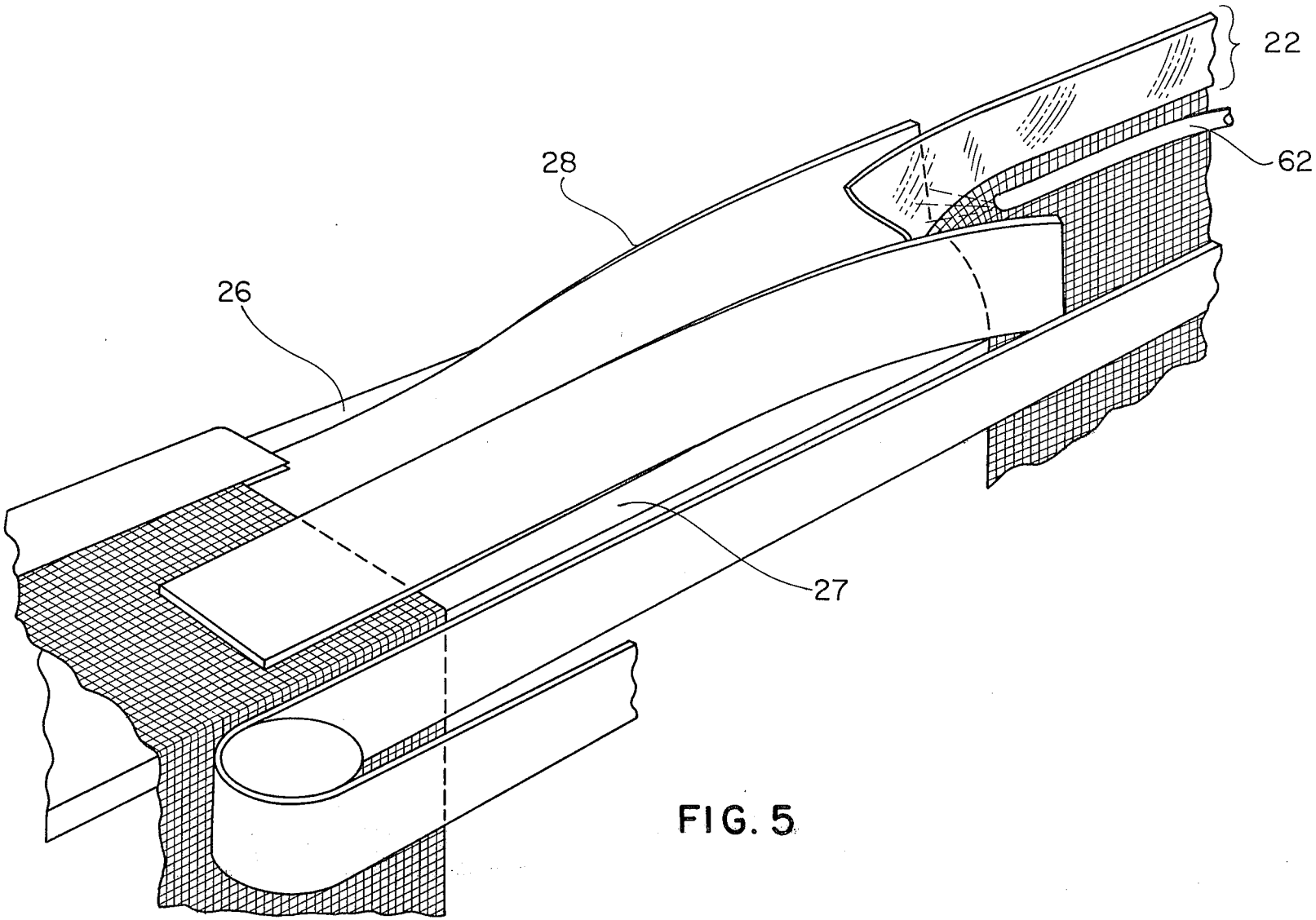
FIG. 5 is an enlarged perspective view of the plow member of the preferred embodiment shown in FIG. 2.

The operation of apparatus 10 will now be discussed. 2- to 3- mil thick, 1- to 3- ounce base weight scrim reinforced polyethylene material bags, or sheets of other very thin and lightweight material, may be fed to the vertical-to-horizontal conveyor 10 from a vertical feed device such as a bag making machine at a rate, illustratively, from 20 to 30 bags per minute. The plow member 28 may be mounted along the top edge of the tunnel plates 26 and 27 such as shown in FIG. 5.

As region 22 enters the plow member 28, a stream of air from an air hose 62 connected to a source of air (not shown) is directed against region 22 to assist the turning the region 22 over from a vertical to a horizontal orientation.

The speed of the drive system for the first pair of vertically disposed endless belts 31 and 32, is adjusted to correspond to the speed of the transfer belts 16 and 18 which supply the bags. Similarly the speed of the second vertically disposed endless belts disposed along the height side 38 of the transition board is also adjusted to permit smooth transfer of the bags over the board.

If the free flow of the bags over top surface 44 is disturbed for example, a bag becomes clogged between the ball bearing, hold-down bars 50—50, the bars may be raised and pivoted about a plurality of spherical bearings and rod ends 64—64 mounted between the frame structure and the bars without shutting down the operation or stopping the flow of bags.

The spherical bearings and rod ends are adjusted so as to hold down, and restrain, the bags from air resistance and turbulance as the bags move rapidly over the transition board 40.

It is to be understood that the above-described embodiments are mainly illustrative of the principles of the invention. One skilled in the art may make changes and modifications to the embodiments disclosed herein and may devise other embodiments without departing from the scope and the essential characteristics thereof.

I claim:

1. An in-line material conveying system for systematically transferring a continuous supply of flimsy open-mouth plastic bags from a bag making machine to a take-away conveyor, wherein said bag making machine supplies each bag to a pair of horizontally disposed transfer belts in a manner as to cause each bag to be vertically suspended from said horizontal transfer belts; wherein said transfer belts are spaced apart to define a small horizontal width cavity for engaging a bottom margin region of each bag; the bottom margin region extending a chosen distance from a bottom edge of each bag, and the remaining portion of each bag depending unrestrained from the engaged region of the bag; and wherein said take-away conveyor is disposed horizontally with respect to each vertically suspended bag, said system comprising:

(a) a pair of tunnel plates disposed to receive the unrestrained portion of each bag for holding the unrestrained portion in a vertical plane as each bag exits said bag making machine while being transferred by the horizontally disposed transfer belts;

(b) a plow member fixedly mounted to a portion of a top surface of said pair of tunnel plates, in the path of the bottom edge of each bag, for folding over a portion of the bottom margin region of each bag from a vertical orientation to a horizontal orientation as the remainder of each bag is transferred between said pair of tunnel plates by the horizontally disposed transfer belts;

(c) a first pair of vertically disposed endless belts, positioned near another portion of the top surface of said pair of tunnel plates in the path of the horizontally oriented bottom edge of each bag as the bottom region exits said plow member, for further transferring each folded bag between said pair of tunnel plates; and (d) transition means disposed between said pair of tunnel plates and the horizontally disposed take-away conveyor for transferring each folded bag from said pair of tunnel plates to the horizontally disposed take-away conveyor.

2. Apparatus in accordance with claim 1 wherein said transition means include:

(a) a triangular-shaped bag transition board having a height side, a hypotenuse side, and a base side; said hypotenuse side being disposed at an angle of substantially 75° with respect to said base side, said board being disposed at a slope of substantially 10° with respect to a top surface of said horizontally disposed take-away conveyor;

(b) a second pair of vertically disposed endless belts mounted along the height side of said transition board;

(c) a plurality of ball bearing hold-down bars, including a multiplicity of ball bearings disposed at desired locations along each bar, said hold-down bars being mounted over the top surface of said transition board parallel to the height side of the board, said bars being spaced apart substantially equidistant;

(d) a plurality of endless conveyor belts mounted over the top surface of said transition board, spanning the length of said transition board and spaced substantially at equal intervals;

(e) a pair of triangular shaped tunnel plates mounted perpendicular to the hypotenuse side of the transition board and formed to have a top edge descend at the same slope as the slope of said transition board with respect to the base side of said board; and (f) a flexible transition rod mounted curvaturely along a top surface of one of said pair of tunnel plates nearest to said hypotenuse side to provide a desired flow of the bag material along the hypotenuse side of the board.

3. Apparatus in accordance with claim 2 wherein the bottom edge of each flimsy bag is sealed with a length of heat sealed tape and wherein each bag weighs from 1 to 3 ounces.

4. Apparatus in accordance with claim 3 wherein the inner walls of said tunnel plates are lined with a plurality of horizontally positioned static prevention strips for preventing static electric build-up between said plates as the bags travel between the tunnel plates.

5. A method for systematically transferring a continuous supply of flimsy open-mouth plastic bags from a bag making machine to a take-away conveyor comprising the steps of:

(a) providing means for suspending each bag in a vertical orientation so that a taped sealed bottom edge is located above the other end, the other end being an open end of the bag;

(b) suspending each bag in a vertical orientation so as to place the bottom edge above the open-end of the bag;

(c) providing means for transporting each vertically suspended bag over a chosen horizontal path;

(d) transporting each vertically suspended bag over the horizontal path;

(e) providing means for folding over a portion of a bottom margin region of each bag from the vertical orientation to a horizontal orientation as each suspended bag is transported over the horizontal path;

(f) folding the bottom margin region of each suspended bag to the horizontal orientation as the bag is being transported;

(g) providing means for retaining the unfolded portion of each bag vertically suspended as the folded bag is transferred over the horizontal path;

(h) providing means for transferring each folded bag from said vertical retaining means to said take-away conveyor so as to deposit each bag in a horizontal plane upon a top surface of said take-away conveyor; and then (i) transferring each folded bag from said vertical retaining means to said take-away conveyor in a manner to deposit each bag along a horizontal plane upon a top surface of said take-away conveyor.

6. The method of claim 5 where the means for transferring each folded bag from said vertical retaining means to said take-away conveyor is a triangular transition board positioned at approximately a 10° slope between a top edge of said vertical retaining means and the top surface of the take-away conveyor.

* * * * *